US011193260B2

(12) United States Patent
Garrido Martinez

(10) Patent No.: US 11,193,260 B2
(45) Date of Patent: Dec. 7, 2021

(54) AIR FRESHENER AND AUTOMATED UNBLOCKING DEVICE FOR PLUMBING TRAP FOR SINKS, WASH BASINS OR SIMILAR

(71) Applicant: Patrick Garrido Da Concieçao, Logroño (ES)

(72) Inventor: Miguel Angel Garrido Martinez, Logrono (ES)

( * ) Notice: Subject to any disclaimer, the term of this patent is extended or adjusted under 35 U.S.C. 154(b) by 363 days.

(21) Appl. No.: 16/475,995

(22) PCT Filed: Mar. 18, 2019

(86) PCT No.: PCT/ES2019/070180

§ 371 (c)(1),
(2) Date: Jul. 3, 2019

(87) PCT Pub. No.: WO2019/185957

PCT Pub. Date: Oct. 3, 2019

(65) Prior Publication Data

US 2021/0332576 A1 Oct. 28, 2021

(30) Foreign Application Priority Data

Mar. 26, 2018 (ES) ..... 201830414

(51) Int. Cl.
*E03C 1/126* (2006.01)
*E03C 1/308* (2006.01)
*E03C 1/284* (2006.01)

(52) U.S. Cl.
CPC ..... *E03C 1/126* (2013.01); *E03C 1/284* (2013.01); *E03C 1/308* (2013.01)

(58) Field of Classification Search
CPC ..... E03C 1/126; E03C 1/284; E03C 1/308
USPC ..... 4/679
See application file for complete search history.

(56) References Cited

U.S. PATENT DOCUMENTS

2012/0125372 A1 5/2012 Dombrowski
2017/0356175 A1 12/2017 Doung

FOREIGN PATENT DOCUMENTS

CN 102286998 A 12/2011
CN 204326191 U 5/2015
CN 206015809 U 3/2017
ES 1192458 U 10/2017
GB 2383393 A 6/2003
(Continued)

OTHER PUBLICATIONS

International Search Report for corresponding PCT application No. PCT/ES2019/070180, dated May 31, 2019.

*Primary Examiner* — Tuan N Nguyen

(74) *Attorney, Agent, or Firm* — Notaro, Michalos & Zaccaria P.C.

(57) ABSTRACT

Automated unblocking device for plumbing trap for sinks, wash basins or similar, arranged in an installation with a plumbing trap, a pipe, a siphon, a connecting piece, connected to a valve of the basin that is located between the valve of the basin and the siphon and has a receptacle consisting of a compartment of products, a discharge medium compartment and an electronic compartment for control and command, where the mediums for the air freshener functions are housed, including an air freshener discharge pump, an air freshener compressor and a nebuliser as well as an unblocking compartment having a unblocker discharge pump, an unblocking tank with a nozzle for expelling the unblocker to the water supply pipe.

7 Claims, 2 Drawing Sheets

(56) References Cited

FOREIGN PATENT DOCUMENTS

| | | | |
|---|---|---|---|
| JP | S5865832 | A | 4/1983 |
| JP | S58127845 | A | 7/1983 |

AIR FRESHENER AND AUTOMATED UNBLOCKING DEVICE FOR PLUMBING TRAP FOR SINKS, WASH BASINS OR SIMILAR

OBJECT OF THE INVENTION

The present air freshener and automated unblocking device for sinks, wash basins or similar object of the present invention has a receptacle that lodges air freshener means with an air freshener discharge pump, a compressor that discharges air into an injector generating a mixture of air with the air freshener product, which will go up towards the surface via the plumbing trap tube to the exit of the sink, wash basin or similar valve, providing a pleasant atmosphere.

It also has means to function as an unblocker, including an automatic dosing unblocker discharge pump containing a 'gel', caustic soda or unblocker for the pipe above the siphon, so that this unblocking product can slide down the lower walls of the pipe to the siphon and pipe acting on any retention.

The device is programmable by the user and/or acts on demand at any time by actuation on a pushbutton or similar.

BACKGROUND OF THE INVENTION

Among the background of the invention, the Utility Model ES-1192458 by "Plumbing trap for tap installations" stands out, of the same author, which describes and claims a plumbing trap positioned between the drain valve and the siphon, incorporating in its coupling a capsule with an air freshener product, foreseen to counteract the bad smells, and/or a deblocking product, designed to prevent the formation of blockages in tubes, either individually or jointly, actions achieved by dissolving a product in water by passing it through the cartridge containing it, and enhancing the air-freshening effect by using a fan.

This plumbing trap is totally manual and dependent on the flow of water that circulates through the specific pipe, i.e., for the replacement of the respective air freshener and unblocker (normally solid) cartridges must be accessed, which are inserted in the same water pipe from the basin, so it requires certain capacities and causes various inconveniences to the user, so that in many cases after wear of the parts by use, are not replaced. In addition, the intensity of the air freshener and unblocker generally varies according to the state of wear of the tablets of the corresponding product; therefore, a constant use is not generated.

On the other hand, in patent GB2383393A for a "Programmed automatic dispenser of cleaning agents in a duct and system", where the dispenser used for drain tubes, siphons, sinks, etc., includes a cleaning agent tank, as well as batteries, a microchip and a flow control valve. This valve, commanded by the microchip, opens automatically according to the established program, gravity, dropping a quantity of the product into the tube to be cleaned.

In this case, the dispenser only uses a battery commanded by a microchip that opens a valve and lets the cleaning product pass into the pipe, dropping this by gravity, i.e. the amount of cleaning product that releases will depend on the amount of product left in the tank. There is no evidence that this invention uses an air freshener or tube unblocker.

There is another series of inventions, whose automatic devices have a detergent tank or cleaning agent, which, governed by the user, dispenses a certain quantity to the flow of water by means of electro valves that open or close the passage of the detergent to the torrent of water, thus favouring its dosage and mixing. In all of them, the mixture is made by circulating the water through certain cartridges or media, which dose a quantity of disinfectant product, that is, it depends on the water flowing through these media for the mixture.

DESCRIPTION OF THE INVENTION

In order to provide a global solution to all the inconveniences described above, an air freshener and automated unblocking device for plumbing trap for sinks, wash basins or similar described below.

The device comprises a receptacle that collects most of the elements. This receptacle consists of a product compartment, a discharge medium compartment and a control electronics compartment, where the media for the functions are housed:

- Air freshener, comprising a
  - Air freshener discharge pump, which absorbs the air freshener liquid product and pushes it towards a nebuliser located at the opposite end of the air freshener duct, and which expels it towards the water pipe.
  - Air freshener compressor, which pushes pressurised air into the same air freshener nebuliser, causing the air to mix with the air freshener product.
  - Air freshener tank, which is placed in series with the circuit to be absorbed by the pump, this load being easily replaceable.
  - Nebuliser, through which the nebulised mixture is expelled into a cavity towards the pipe.
- Unblocker, consisting of
  - Unblocker discharge pump, dispenser, automatic gel, caustic soda or unblocker for the tube above the siphon, so that this unblocker product slides along the lower walls of the pipe towards the siphon. This unblocker discharge pump is located in an unblocker discharge medium compartment.
  - The unblocking tank is a container or containers with unblocking liquid, from which the pump takes small quantities depending on its programming.
  - Expulsion nozzle of the water pipe unblocker.
- Control, by means of the electronic part with a programmable microchip of control and command, This air freshener insufflation is carried out automatically using a programmable microchip to control the pump and the air compressor, or it can be done manually, i.e. the insufflation is provoked at the user's will by pressing a pushbutton or similar.

The unblocker, once ejected into the pipe, with the user's water loads, drags the unblocker, which flows through the tube acting on any retention.

The device is programmable by the user, for which a programmable microchip is incorporated with a simple display that shows the programming options, such as the injection rate and the dose to be injected, both of the air freshener and of the unblocker, as well as the on/off indicators, The entire electronic control part, as well as the mechanical means of discharge of the products air freshener and unblocker, are located in the department of a receptacle within reach of the user. In the same way, the deposits of the consumable products of the air freshener and unblocker are in another department of the receptacle, also of easy access to the user in order to facilitate the replacement of the products and the maintenance of the device.

Similarly, each of the functions of this device, i.e. air freshener, unblocker, or others such as disinfectant, are equipped with their respective controls/buttons in such a way that regardless of the programming established in the circuit, the user has the option of activating any of the functions at will by actuating it by means of the respective pushbutton control.

In other words, once the dosage has been programmed, it is constant and independent of the use that is given to the installation, not depending on the water that flows through the pipe, nor on the quantity of product that remains in the respective deposit, but rather it will project it until its level is impracticable by the corresponding pump.

The various electrical devices mounted on the device are supplied by means of a mains connection. As long as the devices, such as pumps and compressors, have a small power, the electrical consumption of the unit is minimal.

Notwithstanding the above, the programmable microchip, regardless of its connection to the mains, has a power supply battery from the programme memory in order to prevent it from being erased when it is disconnected from the mains supply.

On the other hand, the injection points of the air freshener and unblocker to the tube is made in a connecting piece located between the valve of the sink, wash basin or similar and the siphon, as for example through a double 'T' piece, a simple T, quick couplings or any means that allows the introduction of liquids. The communication between the receptacle supplying the products to be injected and the injection nebuliser is therefore carried out by means of the corresponding ducts.

In this connecting piece the corresponding ejectors are inserted; on the one hand a nebuliser that expels the mixture of air and air freshener in the interior of the pipe by means of a few tiny holes that nebulise this mixture. This mixture takes place in a cavity where the ducts of the air freshener supply the air compartment, i.e. the air freshener duct and the air duct, flow out. This nebuliser of the mixture of air and air freshener is materialised in an injector nozzle.

On the other hand, in the connecting piece, an ejector is placed which consists of a nozzle that introduces into the pipe the unblocking liquid guided by the unblocking conduit from the unblocking tank in liquid or gel form. That is to say, the unblocker discharge pump drives the unblocker product that is in its compartment, through an unblocking duct to its corresponding outlet in the connecting piece, pouring the pumped quantity into the conduit, and this product flows through the water pipe until it is deposited in the siphon by gravity. An unblocking product that is partially mixed with resting water, but is washed away by the water when a current is generated.

This device can also hold a disinfectant product for the tubes, as it is well known that most germs are generated in this part of the water tubes. The means and way of acting would be identical to that mentioned for the unblocker. Therefore, this device may use a disinfectant product, or a product combining both unblocking and disinfecting characteristics.

For the air freshener functions, the air freshener compartment of the receptacle also has an air freshener tank on one side. This tank can be fixed, in cases where a refillable tank with air freshener is chosen or removable for cases where a replacement system is used.

The pump and the air freshener compressor work synchronously, in such a way that when they receive the order of expulsion of air freshener to the pipe, both mechanisms (pump and air compressor) provide the corresponding amount of air freshener and air, liquids that circulate through their corresponding ducts to a cavity before the end, where the mixture of both is made, which expels the pipe of water dispersing it in the form of mist through the nebuliser.

This mist (mixture of air and fogged air freshener), once in the pipe of water, tends to rise due to the pressure with which it is expelled, so it will be directed towards the top of said pipe, leaving through the valve of the sink, wash basin or similar, towards the interior of the premises, providing a pleasant fragrance instead of the typical bad smells.

The mist introduced in the pipe cannot circulate downstream but only up to the surface of the water contained in the siphon, lightly impregnating this and flavouring it, so the amount of air freshener that is wasted is minimal or virtually nil.

The programmable microchip links the control of the discharge media with push buttons, so that the discharge media of the air freshener, pump and air freshener compressor, are momentarily activated by the actuation of an air freshener button by the user. In the same way, the unblocker discharge pump will be activated during the time that the corresponding unblocker pushbutton is being operated.

Advantages of the Invention

From the description of the invention, the following advantages are derived in relation to the state of the art:

- The operating mechanisms, such as the corresponding discharge pumps for the product to be injected and the air compressor, are located in a receptacle located in a comfortable and practical position for both the user and maintenance.
- In the same way, the deposits of the products that are driven (air freshener, unblocker, disinfectant, etc.) are located in another compartment of the previous receptacle, so their replacement and/or filling are practical and comfortable for the user.
- This device does not require attention on the part of the user, but the program itself emits its corresponding dose determined by the programming of air freshener, unblocker, disinfectant, or the product to be supplied.
- The programmed dosage is constant and automatic, since it does not depend on the quantity of product left or on the flow of water that circulates through the pipe.
- In addition to the automatic dosage, the user has the option of an extra load at any time by acting on the corresponding pushbutton of the chosen circuit, thus giving a greater actuation of a product at the required time.
- The air freshener is used to the maximum because it is not lost in the water that circulates through the pipe, but rises through the valve to the basin.

DESCRIPTION OF THE FIGURES

In order to better understand the object of the present invention, a preferential practical embodiment of it has been represented in the annexed drawing.

PREFERRED EMBODIMENT OF THE INVENTION

The constitution and characteristics of the invention may be better understood with the following description made with reference to the attached figures.

Figure 1:
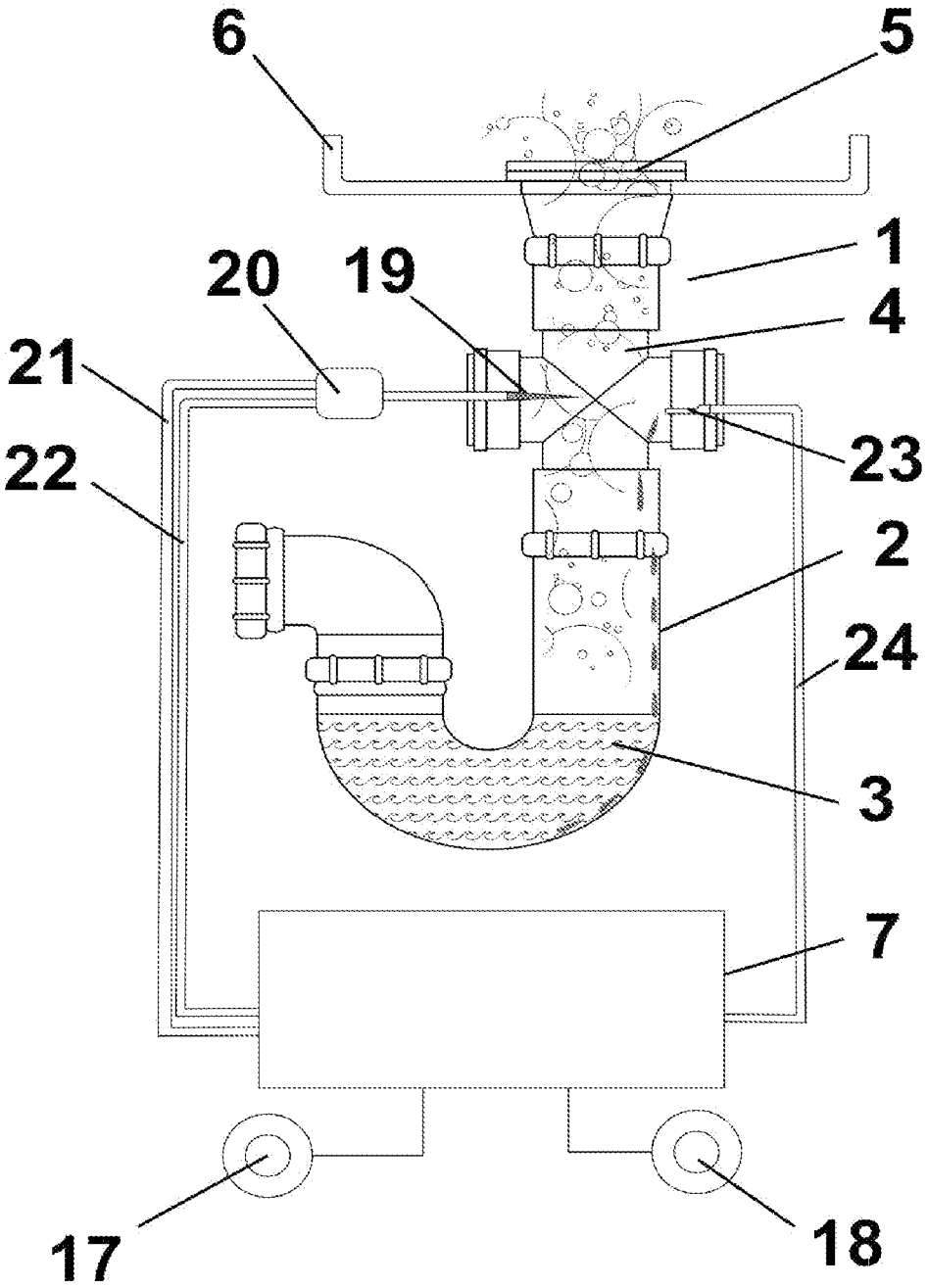
FIG. 1— shows a schematic view of the device covered by this invention.
Figure 2:
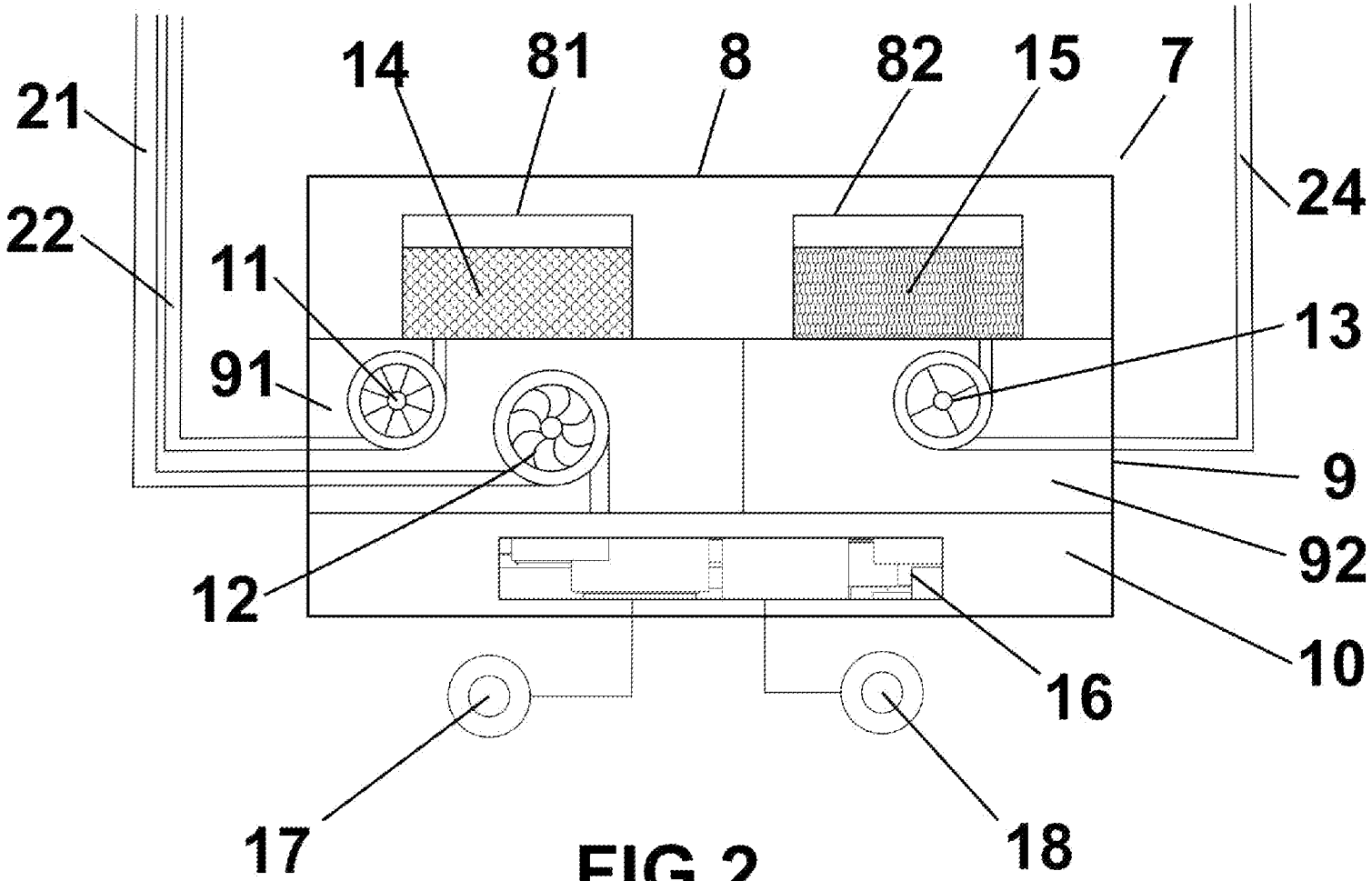
FIG. 2 shows a schematic view of the components of the receptacle in FIG. 1.

In FIG. 1 and FIG. 2 this device is represented in a simplified way, the installation of which firstly shows a plumbing trap (1) in which a water pipe (2) can be distinguished, a siphon (3), a connecting piece (4), connected with a valve (5) of the basin (6), where the device consists of a receptacle (7) that collects most of the elements.

This receptacle (7) consists of a product compartment (8), a discharge medium compartment (9) and a control electronics compartment (10).

The product compartment (8) has inside accommodations for an air freshener tank (81) and a plunger product tank (82), as well as any other consumable product tank for injection into the water supply pipe (2). On the other hand, the discharge medium compartment (9) houses an air freshener discharge medium compartment (91) consisting of an air freshener discharge pump (11) and an air compressor (12) and an unblocker discharge medium compartment (92) with an unblocker discharge pump (13).

The tanks (81 and 82) may be fixed in the product compartment (8), especially in cases where the product in question is refillable or where there is a corresponding anchorage for tanks which are replaced by new ones. These tanks contain the product consumed in the pipe, i.e. the air freshener tank (81) will contain an air freshener (14), preferably liquid, and the unblocking tank (82) will contain the unblocking product itself (15).

At the same time, the compartment of the electronic control and command part (10), houses a programmable microchip (16) which allows the user to choose between a certain number of pre-established programs or to personally program the cadence and automatic dose of the products in the pipe of evacuation of the waters from the basin (6) or sink.

In addition, this programmable microchip also links the control of the supply media with push buttons, so that the supply media of the air freshener, pump (11) and air compressor (12) of the air freshener, are momentarily activated by the actuation of an air freshener push button (17) by the user. In the same way, the unblocker discharge pump (13) will be activated during the time that the corresponding unblocker pushbutton (18) is being operated.

On the one hand, in this connecting piece (4), the corresponding ejectors are inserted, including a nebuliser (19) that expels the mixture of air and air freshener (14) in the form of a mist inside the pipe (2) by means of a few tiny holes that nebulise this mixture. This mixture takes place in a cavity (20) where the ducts of the air freshener supply the air compartment (91) end, i.e. on the one hand the air freshener duct (21) and on the other the air duct (22).

At another point of the connecting piece (4) the ejector consists of a nozzle (23) which introduces into the pipe (2) the unblocking liquid (15) guided by the unblocking duct (24) from the unblocking tank (82) in the form of a liquid or gel which by gravity will descend through the pipe (2) towards the siphon (3) mixing partially with the water maintained in the siphon.

Its application is very simple, to this end, once the tank of air freshener (81) contains air freshener (14) and unblocking tank (82) contains unblocker (15), when the selected program of the programmable microchip (16) sends the order to the means of impulsion, pump (11) and air compressor (12) of air freshener, these impel the air freshener (14) and the air through the respective ducts (21 and 22) to the cavity (20) where the mixture of both liquids is produced, and then pass through a single duct to the nebuliser (19) which nebulises the mixture and injects it into the pipe (2) of water in the form of mist.

Due to the difference in pressure and density, this mist with air freshener ascends through the pipe (2) towards the valve (5) and exits outwards through the basin (6). On the other hand, the part of the mist that is more dense than the air, or due to air saturation, will descend towards the lower part of the pipe (2) to the water of the siphon, impregnating it slightly with air freshener.

In the case of the unblocker, the command of the programmable microchip (16) acts on the unblocker discharge pump (13), which drives the unblocker (15) through the unblocker tube (24) to the nozzle (23), and from there to the inside of the pipe (2). This unblocking liquid (15), being more dense than the water and not fogged by the nozzle (23), will descend through the pipe (2) of water towards the siphon (3), normally through the walls of the pipe itself (2), so a light sheet of unblocking product (15) will be created at the bottom of the siphon (3) and another part will be dissolved in the water itself.

When the user charges the water through the pipe (2) from the basin (6), it drags the unblocking product (15) deposited on the pipe (2) walls and at the bottom of the siphon (3) through the drain, acting on those points that obstruct the passage of the water and exercising its unblocking function.

On the other hand, apart from the commands of the programmable microchip program (16), the user can at any time operate on the pushbutton of the air freshener (17), which causes an action on the air freshener means of impulsion, pump (11) and air compressor (12), and the corresponding air freshener ejection (14) in the pipe (2) towards the outside by the basin (6) as described above.

In the event that the user acts on the unblocker pushbutton (18), its specific operation as a unblocker will be as described above for the device as an unblocker, but it will only function for the duration of the pushbutton operation.

The invention claimed is:

1. An automated unblocking device for plumbing trap for sinks or wash basins, arranged in an installation with a plumbing trap (1), a pipe (2), a siphon (3), a connecting piece (4), connected to a valve (5) located between a basin (6) and the siphon (3), the device comprising a receptacle (7) consisting of a compartment of products (8), a discharge medium compartment (9) and an electronic compartment (10) for control and command, where an air freshener tank (81) is housed, a discharge pump (11), an air freshener compressor (12) and a nebuliser (19), the receptacle (7) is also equipped with an electronic control (10) with a programmable microchip (16) for control and command, and an unblocking compartment comprises:

an unblocker discharge pump (13), an automatic dosing of unblocker (15) to the pipe (2) above the siphon (3);

an unblocking tank (82), an unblocking duct (24), a nozzle (23) for ejecting the unblocker to the water pipe (2).

2. The automated unblocking device for plumbing trap for sinks or wash basins, according to claim 1, characterised in that a mixture of air and air freshener (14) is produced in a cavity (20) where an air freshener duct (21) and an air duct (22) end.

3. The automated unblocking device for plumbing trap for sinks or wash basins, according claim 1, characterised in that the nebuliser (19), which is expelling a mixture of air and air freshener (14) in the form of a mist from an injection nozzle.

4. The automated unblocking device for plumbing trap for sinks or wash basins, according to claim 1, characterised in that the air freshener (81) and unblocker (82) tanks are fixed with refillable contents.

5. The automated unblocking device for plumbing trap for sinks or wash basins, according to claim 1, characterized in that the air freshener (81) and unblocker (82) tanks are removable and replaceable.

6. The automated unblocking device for plumbing trap for sinks or wash basins, according to claim 1, characterised in that the programmable microchip (16) links the control of the discharge media with an air freshener pushbutton (17), so that the discharge media of the air freshener, pump (11) and air compressor (12) of the air freshener, are momentarily activated by the actuation of the air freshener pushbutton (17) by the user.

7. The automated unblocking device for plumbing trap for sinks or wash basins, according to claim 1, characterized in that the programmable microchip (16) links the command of the discharge media with an unblocking pushbutton (18), in such a way that the discharge media of the unblocker discharge pump (13) will be activated during the time that the unblocking pushbutton (18) is being acted on.

* * * * *